US006024677A

United States Patent [19]

Siwertz

[11] Patent Number: 6,024,677

[45] Date of Patent: Feb. 15, 2000

[54] APPARATUS FOR PHYSICAL EXERCISE

[76] Inventor: Torbjörn Siwertz, S-754 20, Uppsala, Sweden

[21] Appl. No.: 09/164,336

[22] Filed: Oct. 1, 1998

[51] Int. Cl.[7] ..... A63B 21/068

[52] U.S. Cl. ..... 482/96; 482/135; 482/142

[58] Field of Search ..... 482/72, 95, 96, 482/132, 134–136, 142, 145

[56] References Cited

U.S. PATENT DOCUMENTS

| | | | |
|---|---|---|---|
| 339,638 | 4/1886 | Goldie | 482/96 |
| 682,988 | 9/1901 | Hazelip . | |
| 3,658,327 | 4/1972 | Thiede . | |
| 4,272,074 | 6/1981 | Sferle | 482/96 |
| 4,468,025 | 8/1984 | Sferle | 482/96 |
| 5,620,403 | 4/1997 | Lundin | 482/96 |
| 5,810,698 | 9/1998 | Hullett et al. | 482/96 |
| 5,906,564 | 5/1999 | Jacobsen | 482/96 |
| 5,938,571 | 8/1999 | Stevens | 482/96 |

FOREIGN PATENT DOCUMENTS

| | | | |
|---|---|---|---|
| 161441 | 9/1904 | Germany | 482/72 |
| 3744954 | 3/1988 | Germany . | |
| 1818112 | 5/1993 | U.S.S.R. | 482/94 |
| 2133706 | 8/1984 | United Kingdom . | |

*Primary Examiner*—Richard J. Apley
*Assistant Examiner*—Victor Hwang
*Attorney, Agent, or Firm*—Young & Thompson

[57] ABSTRACT

Apparatus for training of muscles, comprising a support (1) wherein a sliding seat (6) is supported on a rail (4), said rail being adjustable to permit the seat sliding travels in desired angles to a horizontal plane, and two-pulley cables (7,8) are attached in the support and longitudinally adjustable, the load of said pulley cables being adjusted as desired by threading the cables in alternative running paths in the apparatus, and through which pulley cables the user moves his body along the rail while resting on the seat for training the muscles of arms, legs and body exclusively against the load of his own body weight, said load being adjusted to the user's muscle strength through an appropriate selection of the running path and power reduction of the pulley cables and the seat angle relative to the horizontal plane.

11 Claims, 5 Drawing Sheets

APPARATUS FOR PHYSICAL EXERCISE

The present invention relates to an apparatus for physical exercise, and more particularly to an apparatus in which a plurality of muscles may be activated, utilizing the body weight of the user as a mobile load.

Other apparatus are known, wherein a common feature is to dimension the load by applying weights, tension springs or elastic elements, etc. A drawback in these known arrangements is related to difficulties in obtaining a continuous adjustment of the load, to which effect a plurality of weights or springs are needed in form of auxiliary equipment that may both raise the price of the product, increase the transport weight, and render the adjustment of the load to the muscle strength of the user more complicated.

DE 3 744 954 shows a rowing machine having a seat slideable on a beam. In one end, the beam is connectable to a leg in desired height positions, continuously adjustable to varying slope angles. Pulley cables are attached to the sliding seat and pass around pulleys which are arranged in the top end of the beam. The free ends of the pulley cables includes handles for the user to tow himself upwards along the beam, bringing the seat sliding under him. The load is adjusted by two rubber bands running under the seat and biasing the seat towards the lower end of the beam, where the rubber bands are fastened. The rowing machine allows only for a limited number of motions for muscle training.

U.S. Pat. No. 682,988, GB 2 133 706 and U.S. Pat. No. 3,658,327 are all of the rowing machine type wherein the user, resting on a sliding seat, moves along a sloping path through a pulling motion. All of these known arrangements are first or exclusively adapted for training the arm muscles in a pulling motion, and do not provide the possibility of varying the exercise motion by alternative threading of the pulley cables, to allow for training of a plurality of muscle sets.

The object of the present invention is therefore to provide an apparatus, which is easily transported and configured to admit training of a plurality of muscles of arms, legs and body, at different and adjustable loads whereby the weight of the user constitutes the variable load.

This object is met in an apparatus, having the features of the appended claims.

Figure 1:
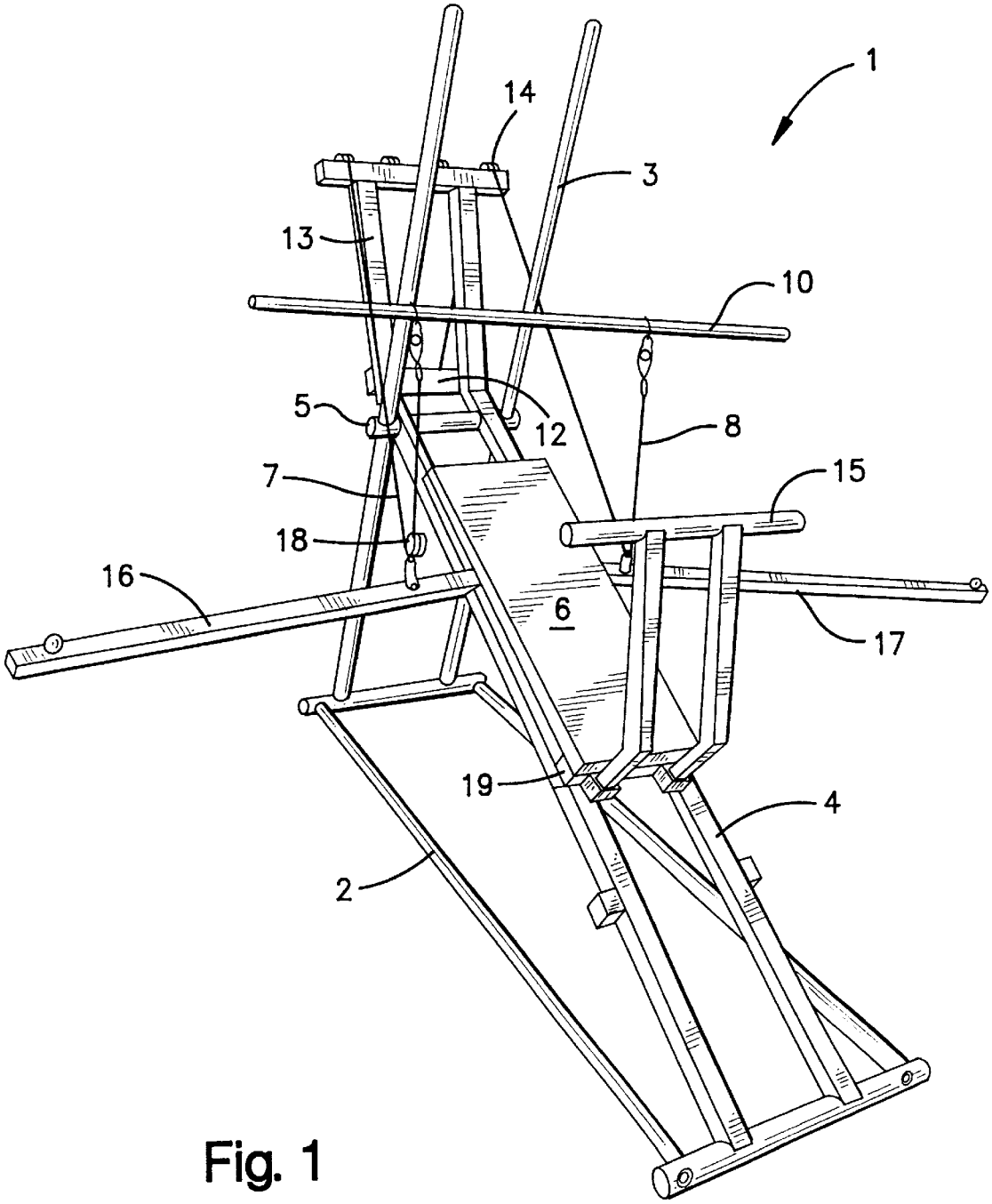

In the following, the invention is further disclosed in connection with an examplifying embodiment, reference being made to the accompanying diagrammetical drawings, wherein FIG. 1 is a perspective view of an apparatus according to the invention, prepared for training arm muscles, and FIGS. 2a–d shows the apparatus of FIG. 1 prepared for training of other sets of muscles, respctively.

The embodiment of an apparatus for physical exercise, shown in FIG. 1, comprises a stand 1 having a base support 2 with a rotatably attached support element 3 connected to one end of the base support. Said base support 2 may be formed as a plate (not shown), but may also have the shape of a frame 2 as shown in the drawings. The support element 3 comprises two poles running in parallel, and includes means for supporting a rail 4, attachable to the support element 3 at desired height positions. Said means may comprise through holes, heels or other means 5 of similar function for supporting one end of the rail 4. Said rail includes two beams running in parallel, one end of the beams being resp. rotatably connected to the base support 2 so that the base support 2, the support element 3 and the rail 4 together build up the stand 1 as triangle of variable angles. The rail 4 may alternatively comprise tubular sleeves (not shown) slidably disposed around the poles and secured thereto by locking screws or clamps, whereby the rail is attachable at desired, variable heights to the support element 3.

A sliding bed or a seat, from here on referred to as a seat 6, is supported on the rail 4. Said seat 6 is advantageously supported on the rail 4 by wheels or reels (not shown), running in tracks on the inner sides of the rail which may be formed from U-beams, so that the seat is moveable in a reciprocating motion along the rail 4. Other constructive means for supporting the seat on the rail may also be considered in the course of providing, also under the load of a user, a movability of the seat free from friction in a wider extent.

At the end of the rail 4, adjustable to rest at desired height levels, the rail comprises fastening means for two pulley cables 7 and 8, resp. The pulley cables 7,8 may be formed from lines, ropes, belts, wires or other flexible means, and are preferably non-resilient in a longitudinal direction. The free ends of the pulley cables comprise connecting means adapted for fastening a handle 9 or a handlebar 10, resp., thereto (see also FIGS. 2a–d).

In the shown embodiment, the pulley cables 7,8 are attached to the rail 4 or alternatively to an extension 13, connectable to the rail, through fastening means 12. The pulley cables are longitudinally adjustable in the fastening means 12, the fastening means being adapted for easy connecting and disconnecting the cables and may advantageously be sheet clips or other suitable clamping means.

The pulley cables 7,8 are nonfrictionally threaded in journal means 14, in the shown embodiment arranged on the rail 4 or on the extension 13, connected to the rail. The journal means 14 are adapted to admit, in use, the pulley cables 7,8 to swing at varying angles from the journal means 14. The journal means 14 may be pulleys, reels, blocks, slots, slide elements or equivalents.

Alternatively, the fastening means 12 and journal means 14 may be adapted for both functions of fastening and journalling, resp., of the pulley cables. In this alternative the pulley cables 7,8 may be threaded as desired in alternative paths, either to accommodate or to dispense with the additional power which may be achieved by threading the cables in blocks, around rotating reels, wheels or through a static slide means.

Although not specifically shown herein, the desired operational characteristics of the invention may also be provided in embodiments where the fastening means and journal means are attached to the support element 3. Therefore, the scope of invention should also be considered to include such embodiments which would be obvious to a man skilled in the art, when combining the above said with the rest of the disclosure.

With further reference to FIG. 1, the apparatus of the invention includes a leg rest 15 for the lower part of the user's legs. The leg rest 15 is extended from the lower end of the sloping seat 6. Said leg rest 15 comprises a transversal bar which rests on the back side of the user's knees, when the user lies on his back on the seat 6. The leg rest bar is operative to protect the user from slipping on the seat in training motions. The seat 6 comprises sleeves (not shown) for accommodating the leg rest 15, by which the leg rest is adjustable in height. The leg rest is preferably angularly shaped as in the drawings to provide mounting alternatives, and may in this case be mounted with the transversal bar extended above the seat, or may be reversed with the transversal bar extended forward from the lower end of the seat 6 (not shown).

Two extension beams 16 and 17 are transversally attached to protrude from the sides, resp., of the seat 6. Said beams 16,17 comprise alternative fastening means, e.g. eyes or eyelets, for attaching the pulley cables 7,8 in such way, that the pulley cables may be threaded in varying paths in adaptation to a desired load and pulling length for a great variety of exercise motions. For this purpose, the pulley cables are threaded in rotating wheels, reels or blocks 18, attached to the fastening means of the extension beams 16,17. By threading the pulley cables through blocks, additional power output may be achieved if desired. The seat 6 comprises at least two alternative attachment points for the extension beams 16,17, an upper attachment and a lower attachment 19, in which the extension beams are inserted for training of muscles in arms or legs, resp.

Figure 2A:
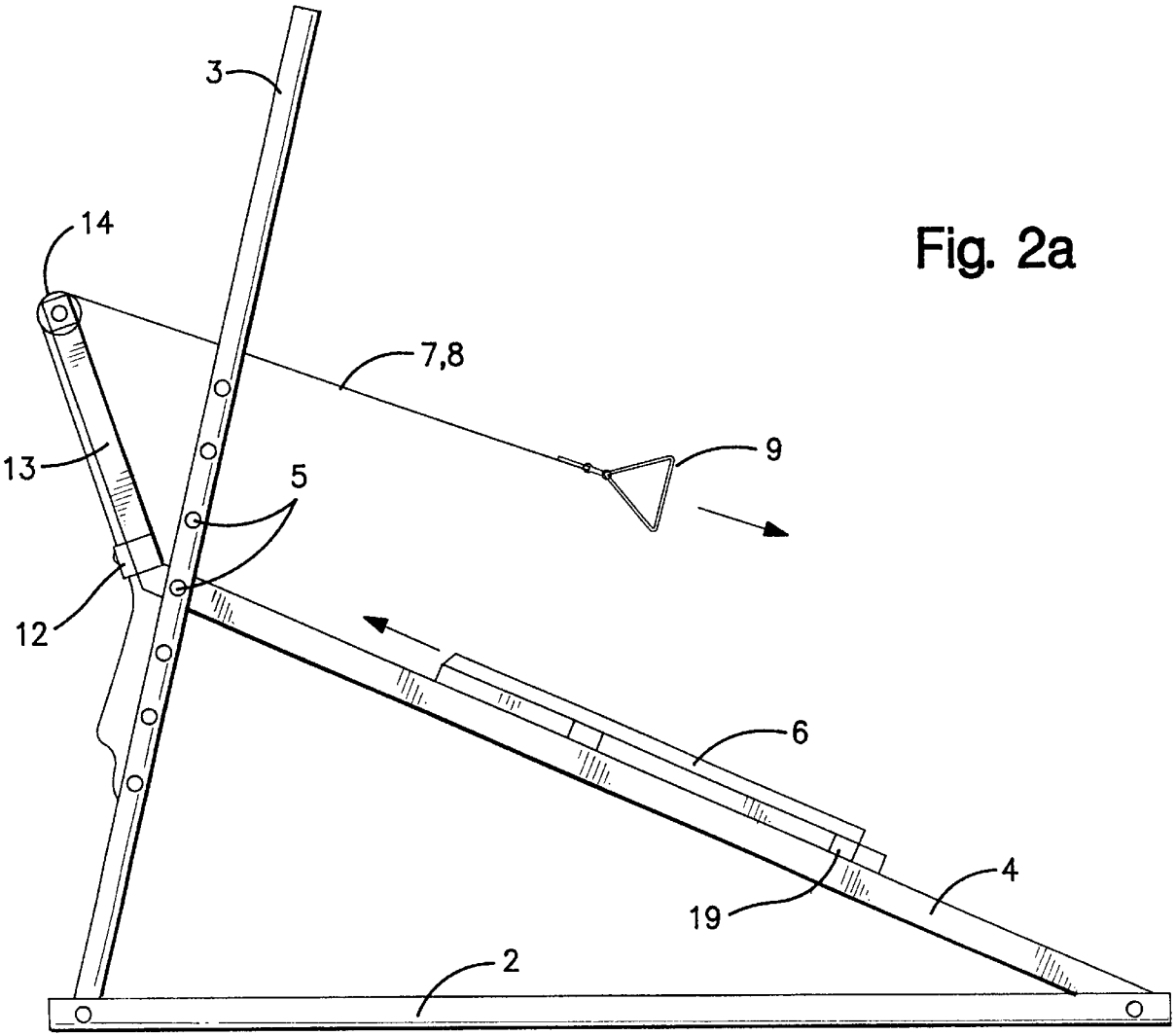
Figure 2B:
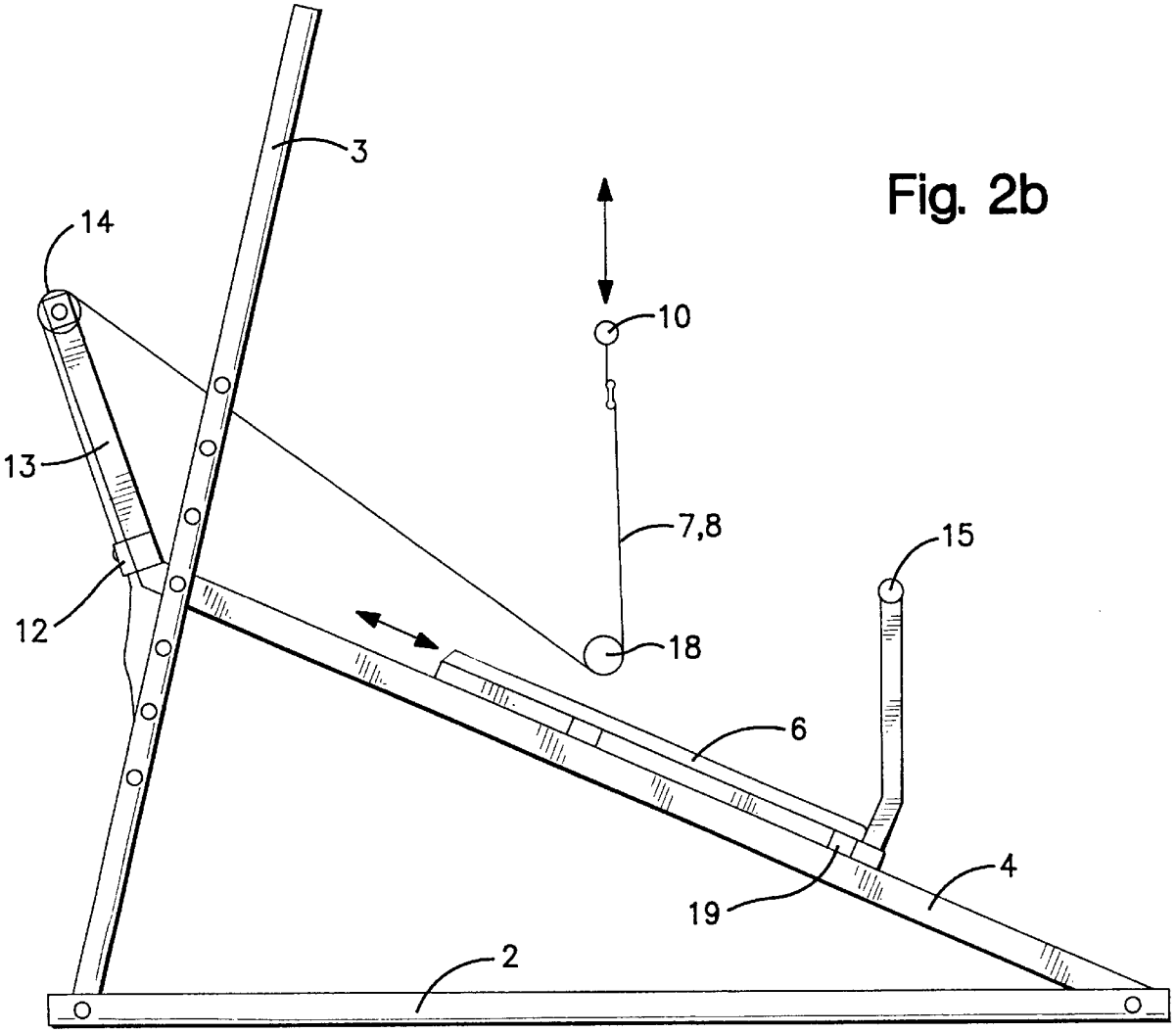
Figure 2C:
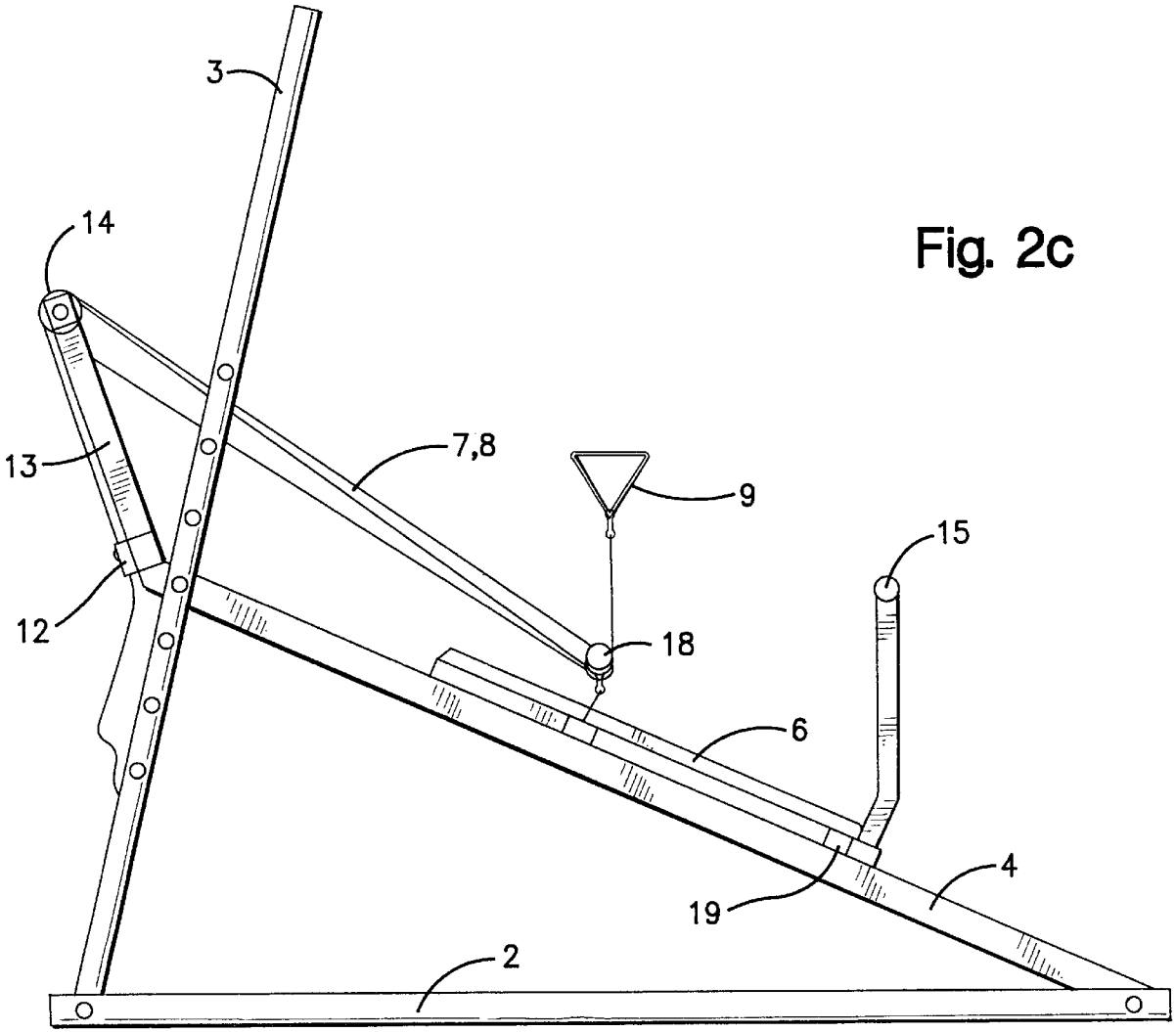

In FIGS. 1 and 2*b* of the drawings, the pulley cables run through an inner journal position of the extension beams 16,17, resp., in a path which is aimed for training arm muscles in a straight and parallel pressing motion, to which purpose a handle bar 10 is attached to the free ends of the pulley cables. In FIG. 2*c*, the pulley cables run in a path which provides training of chest muscles through coordinated pulling motions from each side, inwards to a position in front of the user's chest. To this purpose, the pulley cables run through an outer journal position of the extension beams, and the free ends of the cables are separately attached to a handle. Mounting the extension beams 16,17 in the lower attachment point 19 admits training of leg muscles in a kicking motion, by placing the handle bar 10 over the user's ankles and hanging his knees on the transversal bar of the leg rest 15.

Figure 2D:
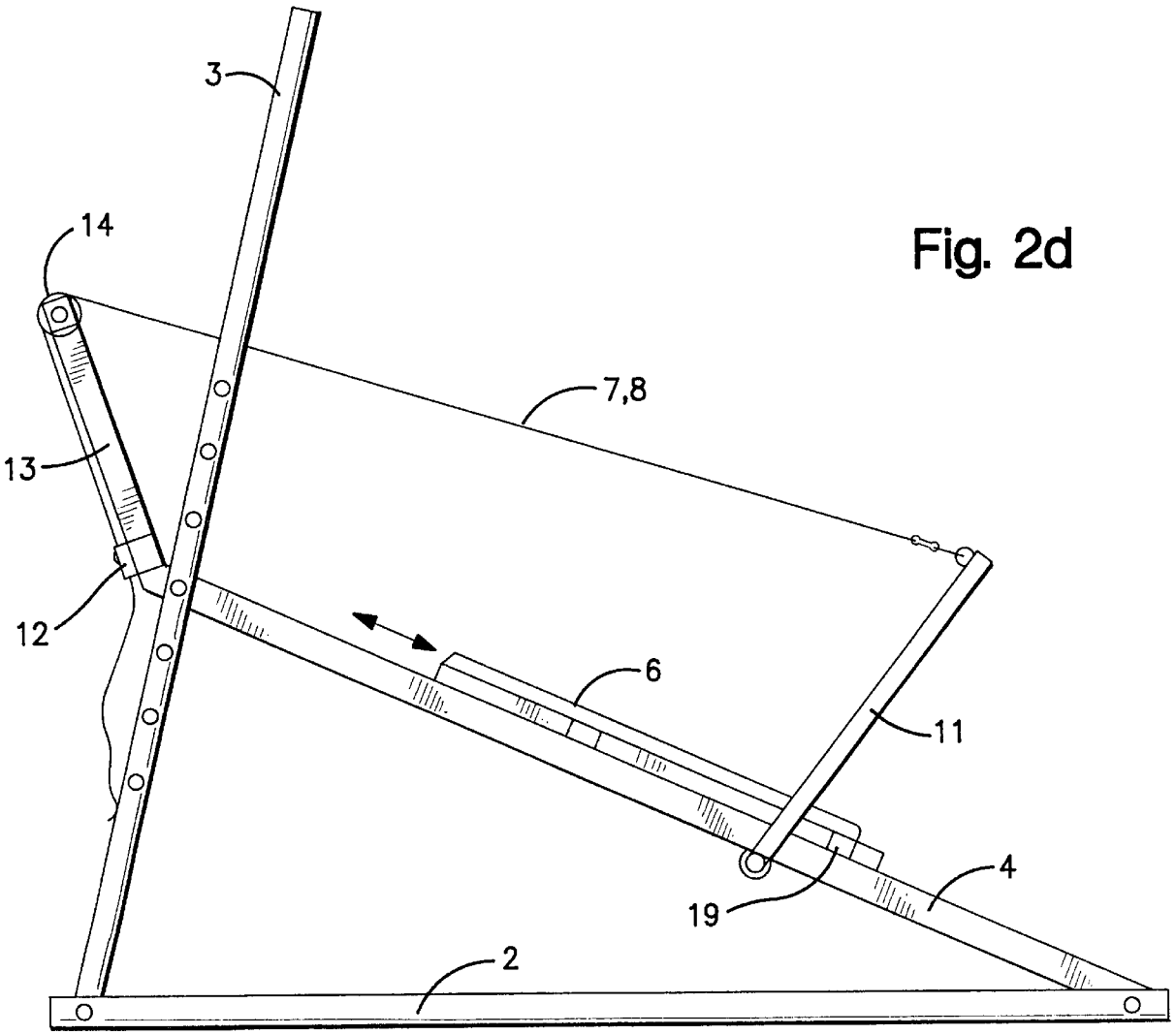

Referring to FIG. 2*a*, the pulley cables 16,17 are threaded in a path aimed at training arm muscles in a pulling motion, whereas FIG. 2*d* shows the pulley cables threaded in a path which admits training arm and leg muscles in pressing motions, to which purpose the free ends of the cables are separately attached to press bars 11, pivotally attached to the outside of the two parallel beams, resp., of the rail 4.

The flexibility of the apparatus of the invention provides training of a great number of muscles or sets of muscles: calf muscles; muscles of the thigh front and back sides; trunk muscles; chest muscles; muscles in arms and back; biceps and triceps in more than twenty different motions, only some of them being shown here to disclose the invention.

Even if only some of the possible conversions of the training device have been shown, it will be understood that the apparatus of the invention provides a wide variation of training motions for muscles in arms, legs and body with the user's body weight as the single, adjustable load, a load which is dimensioned to the muscular strength of the user by adapting the sloping angle of the seat, the alternative threading of the pulley cables and reduction of the motion by means of blocks or as an effect of the pulley cables alternative running paths in the apparatus.

I claim:

1. An exercise apparatus comprising:

a support;

a rail selectively mounted to said support and being structured and arranged to selectively adjust inclination of said rail relative to a horizontal plane;

a seat slidingly supported on said rail;

a pair of cables selectively anchored so that the lengths of said cables are adjustable; and a pair of laterally extending extension beams mounted to said seat, each extension beam being structured and arranged along its length for operatively securing one of said cables at one of at least two locations, wherein a user supported on the seat may engage the cables to move the seat along the rail against resistance provided by the user's body weight and the resistance may be adjusted by selectively adjusting the inclination of the rail relative to horizontal.

2. The exercise apparatus of claim 1, further comprising:

a transverse bar attached to said seat, said bar adapted to engage the back of a user's knee.

3. The exercise apparatus of claim 2, wherein said transverse bar is selectively attached to said seat so that said bar may be reversibly oriented relative to said seat.

4. The exercise apparatus of claim 1, further comprising:

a pair of bars attached to the rail;

each said cable having a free end opposite its selective anchoring to the apparatus;

each said bar including means for selective connection to the free end of one of said cables;

wherein the user engages the cables by pressing on said bars and moves the seat along the rail against resistance provided by the user's body weight.

5. The exercise apparatus of claim 4, wherein each bar is pivotally attached to the rail.

6. The exercise apparatus of claim 1, wherein said rail comprises a pair of parallel beams.

7. The exercise apparatus of claim 1, further comprising:

at least one pulley assembly mounted thereto so that said cables are selectively threaded through said pulley assembly to adjust the resistance to movement of the seat along the rail provided.

8. The exercise apparatus of claim 1, wherein said seat further comprises upper attachment locations and lower attachment locations; and said extension beams are selectively mounted to said seat at said upper attachment locations or said lower attachment locations.

9. The exercise apparatus of claim 1, wherein said rail further comprises a journal means for guiding said cables to their respective anchoring.

10. The exercise apparatus of claim 9, wherein said journal means are mounted to an extension of the rail.

11. The exercise apparatus of claim 9, wherein each said cable is selectively anchored to said rail.

* * * * *

UNITED STATES PATENT AND TRADEMARK OFFICE

CERTIFICATE OF CORRECTION

PATENT NO. : 6,024,677

DATED : February 15, 2000

INVENTOR(S) : Torbjörn SIWERTZ

It is certified that error appears in the above-indentified patent and that said Letters Patent is hereby corrected as shown below:

On the title page, insert Item [30] as follows:

--[30] Foreign Application Priority Data

October 1, 1997 [SE] Sweden.....9703583-6--.

Signed and Sealed this

Twenty-eighth Day of November, 2000

*Attest:*

*Attesting Officer*

Q. TODD DICKINSON

*Director of Patents and Trademarks*